United States Patent [19]

Mayfield

[11] Patent Number: 5,033,670

[45] Date of Patent: Jul. 23, 1991

[54] MAILBOX SIGNAL DEVICE

[76] Inventor: Ralph L. Mayfield, 2932 S. Gordon, Wichita, Kans. 67217

[21] Appl. No.: 511,306

[22] Filed: Apr. 19, 1990

Related U.S. Application Data

[63] Continuation-in-part of Ser. No. 294,828, Jan. 9, 1989, abandoned.

[51] Int. Cl.[5] ..... B65D 91/00

[52] U.S. Cl. ..... 232/34

[58] Field of Search ..... 232/35, 34, 17

[56] References Cited

U.S. PATENT DOCUMENTS

| | | | |
|---|---|---|---|
| 708,189 | 9/1902 | Wirt | 232/34 |
| 898,000 | 9/1908 | Patterson et al. | 232/34 |
| 1,567,100 | 12/1925 | Baber | 232/34 |
| 2,025,251 | 12/1935 | Stembronn | 232/34 |
| 2,654,534 | 10/1953 | Van Meter | 232/34 |
| 3,106,335 | 10/1963 | Allan | 232/34 X |

*Primary Examiner*—Robert W. Gibson, Jr.

*Attorney, Agent, or Firm*—Kokjer, Kircher, Bradley, Wharton, Bowman & Johnson

[57] ABSTRACT

A mailbox signal has a base with integral, spaced apart convex projections which cooperate with a spring biased lost motion pivotal connection with a lever to permit the lever to be rotated 360° on the base but releasably hold the lever in any one of four different positions. A reflective plate on the signal indicates the status of the mailbox when the lever is manually rotated to any of its positions. A contoured handle on the lever permits easy rotation of the lever even by a postman in a delivery vehicle.

8 Claims, 2 Drawing Sheets

MAILBOX SIGNAL DEVICE

This is a continuation-in-part of my co-pending application Ser. No. 294,828 filed Jan. 9, 1989 now abandoned.

This invention relates to mailbox signals, and more particularly to a manually operable visual signal for indicating to the postman that mail to be picked up and transported is present in the mailbox or, alternatively, for signaling to the box owner that delivered mail is present in the box.

The need for a signal to indicate the presence of mail in a mailbox to either the postal patron or the postman has long been recognized. Since the postman would otherwise not inspect a box on his route on days when the mail does not contain a delivery for that particular box, a signal for each box to advise the postman to stop to pick up out going mail from the box is necessary. Similarly, a signal to be operated by the postman to advise the box owner that mail has been delivered to his box is desirable. Often mailboxes are located some distance from the box owner's residence. Such a signal prevents premature trips to the box or trips made to the box on days when no mail delivery is made to the box.

A wide variety of signaling devices have been suggested for this purpose. These have ranged from simple, manually operated pivoted levers attached to the mailbox, to relatively elaborate mechanisms interconnected with the mailbox door for signaling the operation of the door and thereby the presence of mail in the box. Devices which are operated automatically when the door of the mailbox is opened are relatively expensive, difficult to install, and are subject to mechanical failures. Since they only signal that the box has been opened, the information conveyed by such signals is quite limited. Accordingly, devices of this type have met with only limited success and are not in widespread use.

On the other hand, manually operable signal levers or 'flags' are in general use on rural type mailboxes. While devices of this type ar relatively simple and therefore inexpensive, the usefulness of such devices is quite limited. Since they are difficult to operate, especially from the seat of a mail delivery vehicle, they are often used only by the patron to signal the presence of mail for pickup by the postman. The postman often will not or cannot operate this type of lever from his vehicle.

Attempts have been made to provide mailbox signals having multiple positions for conveying several different messages concerning the service status of a mailbox. One example is described in the early Wirt U.S. Pat. No. 708,189. The patent shows a four sided "target" for signaling information wherein the target could be turned to any of four positions to signal the service status of the mailbox.

The target is mounted on an elongated, vertical rod received in a tube mounted on the mailbox. To operate the signal, it was necessary to manually lift the target from a V-shaped keeper and rotate the target about the axis of the rod. The difficulty in operating the Wirt signal, especially from the seat of a delivery vehicle, may have been a primary reason that this device has not been widely accepted.

Accordingly, it is a primary object of the present invention to provide a signal for rural type mailboxes which is easy to operate from any position near the mailbox including from the seat of a mail delivery vehicle.

It is another important object of the present invention to provide such an easily operated signal which is capable of conveying several different conditions o service status for the mailbox.

Still another object of this invention is to provide a signal of this type which is constructed in a manner calculated to provide long life and problem free operation eve though the signal is constantly exposed to the weather.

A yet further object of the instant invention to provide a mailbox signal construction which permits easy operation of the signal from any angle, yet which signal reliably maintains the position to which it is set, and which transmits a highly visible signal even in diminished light conditions.

These and other important aims and objectives of the present invention will be further explained or will be apparent from the following claims, explanation and description of the drawings.

Figure 1:
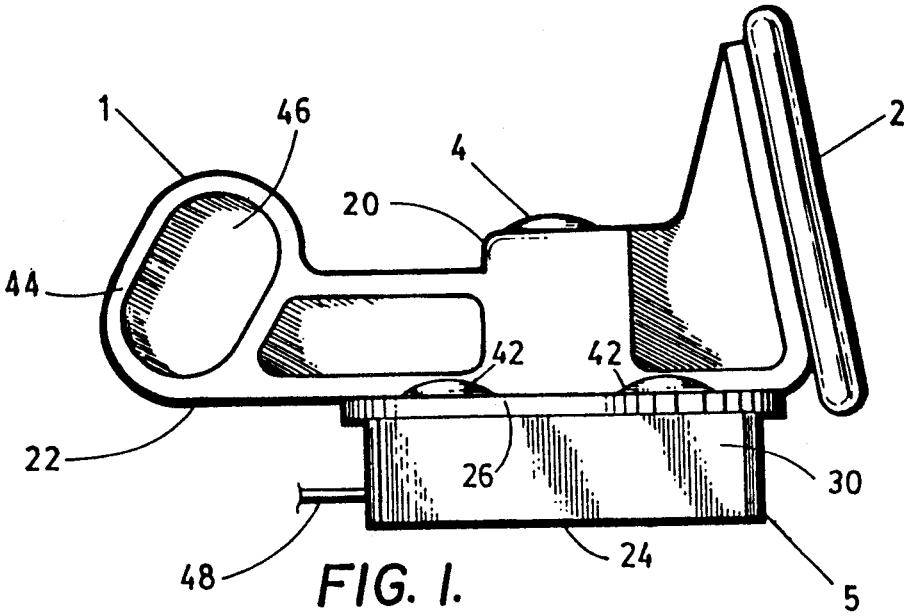
FIG. 1 is a side elevational view of a mailbox signal embodying the principles of this invention.

A signal device embodying the principles of this invention is broadly designated in the drawings by the reference numeral 20. Device 20 includes an elongated, rigid lever 22 and a rigid base 24. Base 24 comprises a generally planar member 26 having a flat upper face 28 and a depending, annular flange 30 which is integrally secured to member 26. The major components of device 20 are preferably formed from a durable plastic material.

Figure 2:
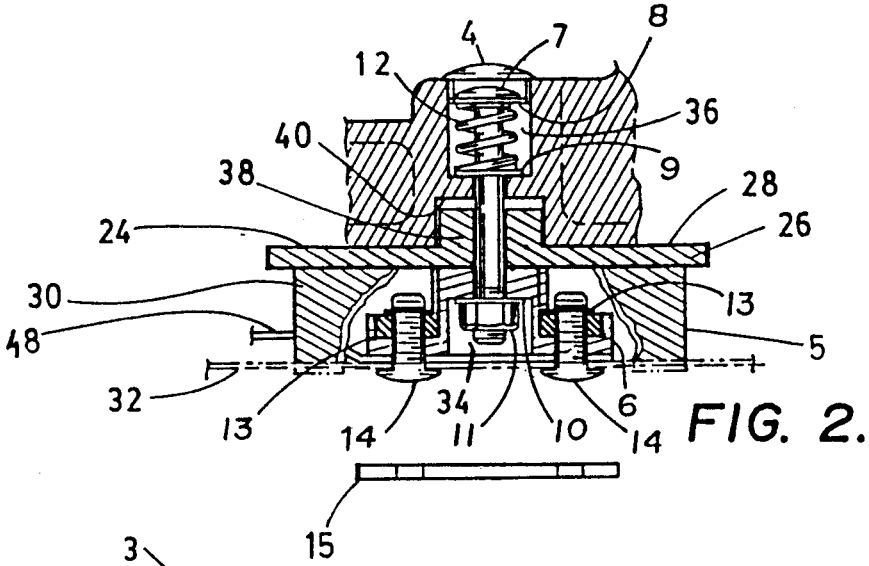
FIG. 2 is a detailed, fragmentary cross-sectional view through the signal in the region designated by the line labeled by the numeral 2 in FIG. 1.
Figure 3:
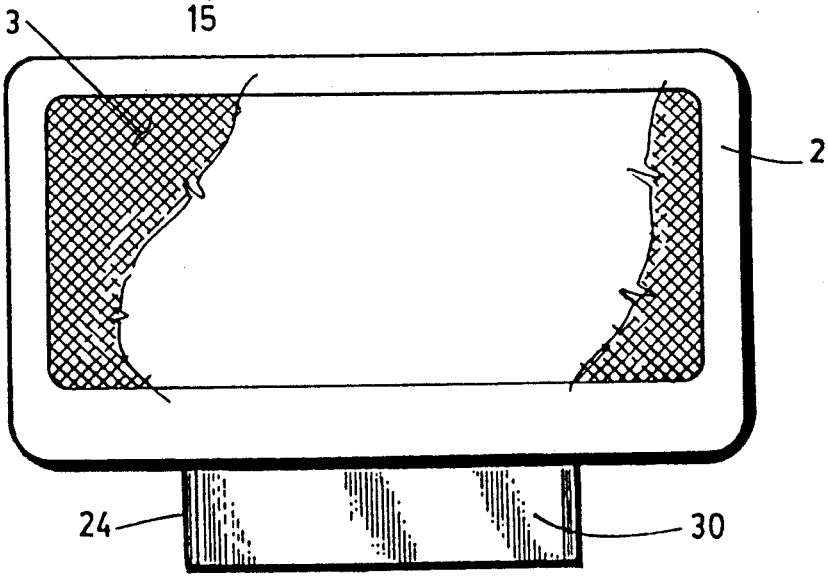
FIG. 3 is a front elevational view of the signal.

An element 6 for fastening base 24 to the upper surface of a mailbox 32 is also preferably molded from durable plastic material into the shape shown best in FIG. 2. Element 6 contains a pair of threaded metal inserts 13 in bores in the element adapted to receive mounting bolts 14 as shown in the drawing. A recess 34 in element 6 receives the nut 11 for a bolt 7 which pivotally secures lever 22 to base 24. A recess 36 in lever 22 receives the head end of bolt 7 and a spring 12 telescoped over bolt 7 and received between spaced apart washers 8 and 9 on the bolt pivotally secure the lever to the base. Preferably, a washer 10 is received on bolt 7 between nut 11 and element 6.

A transversely circular, stub shaft 38 is integral with base member 26 and projects vertically upwardly from face 28 of the member as shown in FIG. 2. Shaft 38 is received in a central recess 40 in the bottom of lever 22 and concentric with recess 36. It will be readily understood that lever 22 is pivotally mounted by bolt 7 to base 24 for movement swinging of the lever about the axis of the bolt. Spring 12 exerts a biasing force on the lever to hold the substantially flat bottom of the lever normally engaged on the face 28 of member 26. However, spring 12 is yieldable to permit limited upward movement of the lever with respect to the base for a purpose which will be hereinafter described.

Figure 4:
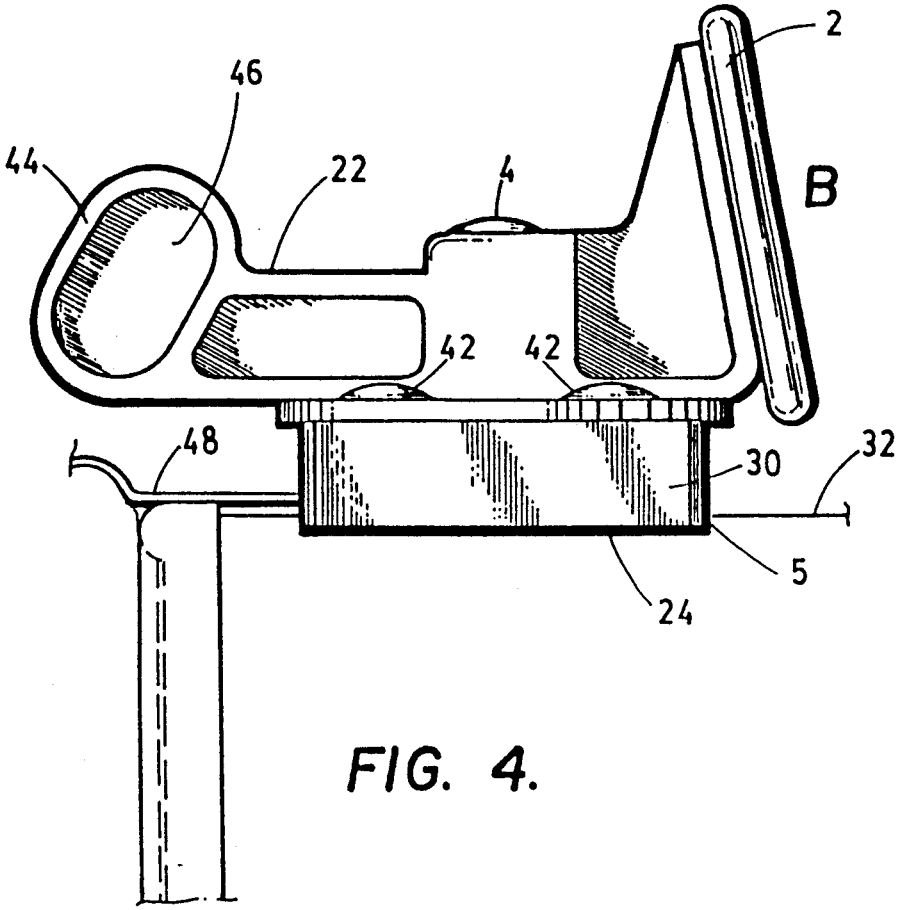
FIG. 4 is a view similar to FIG. 1 but illustrating the position of the signal with respect to the door of the box when signaling a particular service status to the patron.
Figure 5:
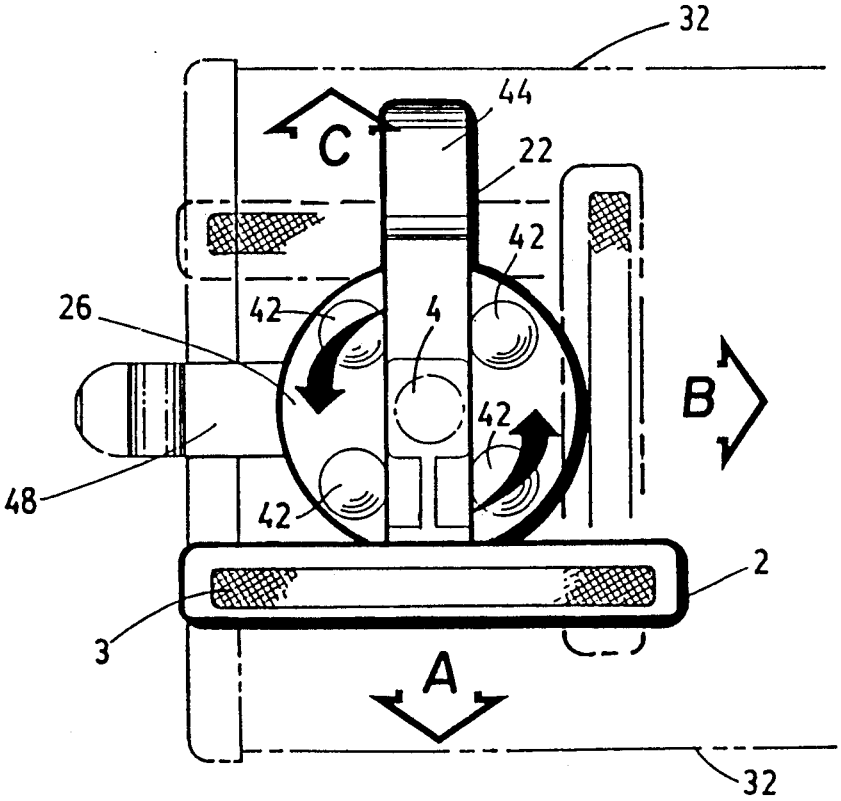
FIG. 5 is a top plan view of the signal, alternate positions for the signal being shown fragmentally in broken lines.

It is desirable that lever 22 may be releasably secured in predetermined positions with respect to bas 24. For this purpose, the upper surface or face 28 of member 26 is provided with a detent means in the nature of a plurality of spaced apart upwardly extending projections 42. Preferably, each projection 42 is molded integrally with member 26 and is convex as shown in FIGS. 1 and 4 of the drawing. Preferably, member 26 is provided with four projections 42 spaced with respect to one another as shown in FIG. 5 so that the projections are spaced equally around the circular member 26. Projections 42 are substantial in size so that lever 22 can be swung 360° about its axis by the sliding of the lever up and over the respective projections 42 in the path of rotation of the lever. The limited upward movement of the lever with respect to the base afforded by spring 12 readily permits such rotation of the lever. On the other hand, it will be understood that the bias of spring 12 cooperates with the obstruction provided by the projections 42 to normally hold the lever in any one of the four positions afforded by the positions of the projections wherein the lever is held in firm engagement against the flat face 28 between aligned pairs of projections.

The manual swinging of lever 22 is facilitated by the provision of a manually engagable handle I on one end of lever 22. Preferably, handle 1 is shaped as shown in the drawing with an outer peripheral rim 44 extending in an oval to define a central recessed portion 46. It will be readily understood that the side of handle 1 opposite that shown in FIGS. 1 and 4 is a mirror image of the latter. Accordingly, handle 1 is conveniently located and comfortable to the operator of the signaling device.

It should be pointed out that handle is disposed radially along lever 22 from the axis of pivoting movement for the lever to provide a considerable mechanical advantage for operating the lever. This ensures that the signal may be moved to any of its available alternate positions regardless of resistance to turning as might be caused by the presence of ice or snow on the device. The relatively large convex projections 42, together with the limited yieldable vertical shifting of the lever from the base afforded by spring 12 provides for a gentle camming action which rocks the lever to physically dislodge the bottom of the lever from the flat surface of the base during rotation from one position to the other. This combination of movement also ensures that any ice which might be present on the signal will be broken to permit rotation of the lever.

A relatively large, preferably generally planar plate 2 is mounted on the end of lever 22 remote from handle 1 and perpendicularly to the longitudinal axis of the lever. A strip 3 of reflective material is mounted on plate 2 in this position to be seen even from relatively long distances from the mailbox. The reflective material 3 ensures that the plate will be readily visible even during conditions of reduced visibility. As shown in the drawing, the reflective face is preferably inclined inwardly at an angle to the axis of swinging of the lever to increase visibility.

In use, the signal device of this invention is preferably installed at the top front of a mailbox in position for easy access by the postal patron and the postal carrier alike. The postal patron may move the signal to the position indicated by the arrow A in FIG. 5 when he deposits mail to be picked up by the carrier in the mailbox. This position for the signal disposes the reflector 3 so that it can be readily seen by the carrier who then knows to stop at the mailbox to pick up the mail for further handling.

If the carrier deposits mail in the mailbox, he can turn the signal to the position shown by the arrow B in FIG. 5. Presumably, the patron's residence is situated in the direction of the arrow from the mailbox. Accordingly, this position for the signal is readily observable by the patron who is advised by the signal that the mailbox has been serviced by the carrier and mail is waiting in the mailbox.

The patron may turn the signal to the position illustrated by the arrow C when he has removed the mail delivered to him from the mailbox. Since the highly visible, reflective surface is facing away from the direction of approach of the carrier o his subsequent route by the mailbox, the carrier knows that there is no mail to be picked up at the box. Obviously, if the carrier deposits mail in the box, the carrier can simply rotate the signal to the position shown by the arrow B so that the patron will know that mail has been left in the mailbox.

It will be readily understood that the bottom edge 5 of base flange 30 may be contoured as necessary to complementally fit the rounded top of most mailboxes. The signal can be provided as a feature of new mailboxes when they are constructed. Alternatively, the signal may also be retrofitted to existing mailboxes. Preferably, the holes for bolts 14 are in the same positions as existing bolt holes on the mailbox for securing the door latch 48 to the box. A reinforcement plate 15 (FIG. 2) may be provided between the inside of mailbox 32 and fastening bolts 14 if it is considered necessary to reinforce the mailbox to stabilize the signal. Further, a cover cap 4 is preferably frictionally installed at the upper end of recess 36 in the handle to prevent moisture from entering the recess.

Having thus described the invention, I claim:

1. A signal for a mailbox, said signal comprising:

a base adapted to be secured to said mailbox, said base having a face;

an elongated, rigid lever engaged against the face of said base;

means pivotally coupling the lever to said base for swinging of the lever with respect to the base;

a signal plate carried by the lever at one end of the latter, said plate being capable of conveying information by the positional relationship of the plate and lever with respect to the base;

a signal plate carried by the lever at one end of the latter, said plate being capable of conveying information by the positional relationship of the plate and lever with respect to the base, there being a manually engageable handle at the end of the lever opposite from said plate, said pivotal coupling means being interposed between the handle and the plate so that manually manipulating the lever in one direction to swing the lever moves the plate in the other direction about said coupling means, said coupling means comprising a stub shaft carried by said base, said lever having a recess telescopically receiving said stub shaft, and bolt means operably securing the lever to the shaft to permit swinging of the lever about said stub shaft.

2. A signal as set forth in claim 1, and detent means between the lever and said base, said detent means being disposed for releasably holding said lever in anyone of a plurality of selectable positions with respect to said base, said detent means comprising a plurality of spaced apart projections on said base and projecting outwardly from said surface, said pivotally coupling means including means to permit limited movement of the lever away from said face for moving over said projections when the lever is manually pivoted with respect to the base.

3. A signal as set forth in claim 2, wherein each of said projections in integral with said face.

4. A signal as set forth in claim 3, wherein each of said projections is convex outwardly from said face.

5. A signal as set forth in claim 2, wherein said bolt means includes spring means normally biasing said lever into engagement with said face, said detent means comprising a plurality of spaced apart, convex projections secured to the base and projecting outwardly from said face, permit sufficient movement of the lever away from the base face to permit manual swinging of the lever.

6. A signal as set forth in claim 5, there being four projections on the base, the projections being equally spaced in disposition to provide four positions for the lever between said projections with the lever engaged against said face, each of said positions being substantially 90° from adjacent positions.

7. A signal as set forth in claim 6, wherein said plate is provided with a panel of reflective material to enhance the visibility of the signal.

8. A signal as set forth in claim 6, wherein said lever and said base ar each formed of relatively durable plastic material.

* * * * *